US008763324B2

(12) United States Patent
Pendley et al.

(10) Patent No.: US 8,763,324 B2
(45) Date of Patent: Jul. 1, 2014

(54) SUPPORT STRUCTURES ON ROOFS

(71) Applicants: Timothy Pendley, Madera, CA (US); Michael J. McLain, Green Bay, WI (US)

(72) Inventors: Timothy Pendley, Madera, CA (US); Michael J. McLain, Green Bay, WI (US)

(73) Assignee: T&M Inventions, LLC, Green Bay, WI (US)

( * ) Notice: Subject to any disclaimer, the term of this patent is extended or adjusted under 35 U.S.C. 154(b) by 0 days.

(21) Appl. No.: 14/036,575

(22) Filed: Sep. 25, 2013

(65) Prior Publication Data

US 2014/0020314 A1 Jan. 23, 2014

Related U.S. Application Data

(63) Continuation of application No. 13/894,092, filed on May 14, 2013, which is a continuation of application No. 13/065,033, filed on Mar. 10, 2011, now Pat. No. 8,438,799, which is a continuation-in-part of application No. 12/932,892, filed on Mar. 8, 2011, now Pat. No. 8,438,798, which is a continuation-in-part of application No. 12/572,176, filed on Oct. 1, 2009, now abandoned.

(60) Provisional application No. 61/102,333, filed on Oct. 2, 2008.

(51) Int. Cl.

| | |
|---|---|
| ***E04D 13/03*** | (2006.01) |
| ***E04D 13/04*** | (2006.01) |
| ***E04D 3/367*** | (2006.01) |
| ***E04D 13/00*** | (2006.01) |
| ***E04D 3/365*** | (2006.01) |
| ***E04B 1/68*** | (2006.01) |

(52) U.S. Cl.

CPC ..... *E04D 13/031* (2013.01); *E04D 13/04* (2013.01); *E04D 13/03* (2013.01); *E04D 13/0315* (2013.01); *E04D 3/364* (2013.01); *E04D 13/00* (2013.01); *E04D 3/365* (2013.01); *E04B 1/6803* (2013.01)

USPC ..... 52/200

(58) Field of Classification Search

USPC ..... 52/200

See application file for complete search history.

(56) References Cited

U.S. PATENT DOCUMENTS

| | | | | |
|---|---|---|---|---|
| 3,521,414 | A * | 7/1970 | Malissa | 52/107 |
| 3,791,088 | A | 2/1974 | Sandow et al. | |

(Continued)

FOREIGN PATENT DOCUMENTS

| | | |
|---|---|---|
| GB | 981948 | 2/1965 |
| JP | 2000336859 | 5/2000 |

(Continued)

OTHER PUBLICATIONS

FAA Facility, photos of skylight installation, 3 pages, Sacramento, CA, prior to 2007.

(Continued)

*Primary Examiner* — Andrew J Triggs

(74) *Attorney, Agent, or Firm* — Thomas D. Wilhelm; Wilhelm Law, S.C.

(57) ABSTRACT

This invention provides upper diverters which are used on support structures on roofs. Such upper diverter has a lower flange which interfaces with the respective roof panel, and an upstanding wall which extends up from the lower flange. The upper diverter diverts water, flowing down the roof, laterally away from the respective roof panel.

8 Claims, 13 Drawing Sheets

(56) References Cited

U.S. PATENT DOCUMENTS

| | | | | | |
|---|---|---|---|---|---|
| 3,828,494 | A | | 8/1974 | Uhrhane et al. | |
| 3,967,423 | A | | 7/1976 | Hammond | |
| 4,117,638 | A | | 10/1978 | Kidd, Jr. et al. | |
| 4,123,883 | A | | 11/1978 | Barber, Jr. et al. | |
| 4,155,206 | A | | 5/1979 | Player | |
| 4,296,581 | A | | 10/1981 | Heckelsberg | |
| 4,470,230 | A | | 9/1984 | Weisner | |
| 4,520,604 | A | | 6/1985 | Halsey et al. | |
| 4,543,753 | A | | 10/1985 | Sonneborn et al. | |
| 4,559,753 | A | * | 12/1985 | Brueske | 52/748.1 |
| 4,621,466 | A | | 11/1986 | Sonneborn et al. | |
| 4,649,680 | A | * | 3/1987 | Weisner et al. | 52/200 |
| 4,703,596 | A | | 11/1987 | Sandow | |
| 4,730,426 | A | | 3/1988 | Weisner et al. | |
| 4,776,141 | A | | 10/1988 | Powell | |
| 4,825,608 | A | | 5/1989 | Makin | |
| 4,848,051 | A | * | 7/1989 | Weisner et al. | 52/200 |
| 4,860,511 | A | * | 8/1989 | Weisner et al. | 52/200 |
| 4,941,300 | A | | 7/1990 | Lyons, Jr. | |
| 4,986,039 | A | | 1/1991 | Weisner | |
| 5,027,576 | A | | 7/1991 | Gustavsson | |
| 5,323,576 | A | * | 6/1994 | Gumpert et al. | 52/200 |
| 5,511,354 | A | | 4/1996 | Eidson | |
| 5,522,189 | A | | 6/1996 | Mortensen et al. | |
| 5,553,425 | A | | 9/1996 | Sampson et al. | |
| 5,561,953 | A | | 10/1996 | Rotter | |
| 5,896,711 | A | | 4/1999 | McClure | |
| 5,960,596 | A | | 10/1999 | Lyons, Sr. | |
| 6,079,167 | A | | 6/2000 | Voegele, Jr. | |
| 6,151,838 | A | | 11/2000 | Husein | |
| 6,640,508 | B2 | | 11/2003 | Lindgren et al. | |
| 6,966,157 | B1 | | 11/2005 | Sandow | |
| 7,043,882 | B2 | | 5/2006 | Gumpert et al. | |
| 7,296,388 | B2 | | 11/2007 | Valentz et al. | |
| 7,308,777 | B2 | | 12/2007 | Sandow | |
| 7,395,636 | B2 | | 7/2008 | Blomberg | |
| 7,712,279 | B2 | | 5/2010 | McClure | |
| 7,721,493 | B2 | | 5/2010 | Skov et al. | |
| 7,736,014 | B2 | | 6/2010 | Blomberg | |
| 8,438,798 | B2 | * | 5/2013 | McLain et al. | 52/200 |
| 8,438,799 | B2 | * | 5/2013 | McLain et al. | 52/200 |
| 8,438,800 | B2 | * | 5/2013 | McLain et al. | 52/200 |
| 8,438,801 | B2 | * | 5/2013 | McLain et al. | 52/200 |
| 8,561,364 | B2 | * | 10/2013 | Pendley et al. | 52/200 |
| 8,567,136 | B2 | * | 10/2013 | Pendley et al. | 52/200 |
| 2004/0049996 | A1 | | 3/2004 | Blomberg | |
| 2005/0204674 | A1 | | 9/2005 | Marshall | |
| 2006/0191230 | A1 | | 8/2006 | Gumpert | |
| 2007/0094984 | A1 | | 5/2007 | McClure | |
| 2007/0101665 | A1 | | 5/2007 | Sandow | |
| 2008/0040993 | A1 | | 2/2008 | Valentz et al. | |
| 2008/0190050 | A1 | | 8/2008 | McClure | |
| 2010/0162643 | A1 | * | 7/2010 | Blomberg et al. | 52/200 |
| 2011/0252726 | A1 | * | 10/2011 | McLain et al. | 52/200 |
| 2011/0252727 | A1 | * | 10/2011 | McLain et al. | 52/200 |
| 2012/0233941 | A1 | * | 9/2012 | McLain et al. | 52/200 |
| 2012/0233942 | A1 | * | 9/2012 | McLain et al. | 52/200 |
| 2013/0167459 | A1 | * | 7/2013 | Pendley et al. | 52/200 |
| 2013/0219825 | A1 | * | 8/2013 | Pendley et al. | 52/710 |
| 2013/0239489 | A1 | * | 9/2013 | Pendley et al. | 52/97 |
| 2013/0239500 | A1 | * | 9/2013 | Pendley et al. | 52/302.1 |
| 2013/0239513 | A1 | * | 9/2013 | Pendley et al. | 52/742.12 |
| 2014/0020314 | A1 | * | 1/2014 | Pendley et al. | 52/200 |
| 2014/0109497 | A1 | * | 4/2014 | Pendley et al. | 52/200 |

FOREIGN PATENT DOCUMENTS

| | | |
|---|---|---|
| JP | 2001214577 | 8/2001 |
| JP | 2008202372 | 9/2008 |
| WO | 2010040006 | 4/2010 |

OTHER PUBLICATIONS

Cross-section and pictorial views of SSR-TUF-LITE daylighting panels, received Jun. 20, 2012, 1 sheet.

Cross-section of VP TUF-LITE Panel—attached to the side of SSR rib, received Jun. 20, 2012, 1 sheet.

Cross-section of Butler Lite Panel—attached to the side of MR24 rib, received Jun. 20, 2012, 1 sheet.

Siemens Building, photos of skylight installation, 6 pages, prior to 2007.

R & S Manufacturing and Sales Company, Inc., Standing Seam 24 Light, Quick Installation Instructions, Under/Over Seam Clip, 12 pages, Newbury Park, CA, Aug. 2012.

R & S Manufacturing and Sales Company, Inc., SS 24 Light, The First Truely Thermally Broken Metal Building Skylight, informational sheet, 1 page, Newbury Park, CA, Aug. 2012.

R & S Manufacturing and Sales Company, Inc., Enlarged sketch of metal roof showing the down slope, 1 page, Newbury Park, CA, Aug. 2012.

Daljcon, LLC., Butler Manufacturing, www.daljcon.com, Example of 6 Layer Standing Seam, printed Dec. 11, 2012.

* cited by examiner

SUPPORT STRUCTURES ON ROOFS

REFERENCE TO RELATED APPLICATIONS

This application is a Continuation of U.S. Non-Provisional patent application Ser. No. 13/894,092, filed May 14, 2013, which is a Continuation of Non-Provisional patent application Ser. No. 13/065,033, filed Mar. 10, 2011, now U.S. Pat. No. 8,438,799, granted May 14, 2013, which is a Continuation-In-Part of U.S. Non-Provisional patent application Ser. No. 12/932,892, filed Mar. 8, 2011, now U.S. Pat. No. 8,438,798, granted May 14, 2013, which is a Continuation-In-Part of U.S. Non-Provisional patent application Ser. No. 12/572,176, filed Oct. 1, 2009, which is a U.S. Non-Provisional Patent Application of U.S. Provisional Patent Application 61/102,333, filed Oct. 2, 2008, the complete disclosure of each of which is incorporated herein by reference, in its entirety.

BACKGROUND OF THE INVENTION

Various systems are known for supporting loads on roofs, and for installing skylights and/or smoke vents into roofs.

The most commonly used skylighting systems are those which incorporate translucent or transparent closure members, also referred to herein as lenses, into a framework which penetrates the roof support structure and may be supported from within the building, with the result that the skylight closure member transmits ambient daylight into the building.

In the past, roof penetrating installations have required a complex structure beneath the exterior roofing panels and inside the building enclosure in order to support a roof curb to which the skylight lens was attached. Conventional skylight curbs are generally in the form of a preassembled box structure, which is mounted within a roof aperture. The retrofitting of such curb systems into an existing roof structure is problematic in that all known conventional structures have a tendency to leak water when subjected to rain.

In today's world of mandated energy efficiency in all types of buildings, the metal building industry needs a more effective way to support skylights and smoke vents, thus to bring daylight into buildings, as well as a more effective way to support a variety of other loads on roofs which have ribs extending the lengths of the metal panels which serve as the outer surfaces of such roofs.

In order to obtain adequate daylighting, conventional skylight and smoke vent installations require multiple roof apertures which extend, cut through and remove plural major elevations, also referred to herein as ribs, in standing seam and other roof panel profiles to make room for corresponding multiple curbs which are conventionally used to support such skylight or smoke vent installations. These multiple curbs, each around a separate roof aperture, create multiple opportunities for water to enter the interior of the building, due to multiple apertures and the widths of the curbs, thus the cuts through the multiple ribs, as well as presenting the challenge to effectively seal the roof at the high ends of such curbs.

The traditional curb constructions and methods of attachment in most cases thus require that a complicated support structure be installed below the roof panel and inside the building enclosure, which can restrict the relative movement of the roof panels and the curb, as associated with thermal expansion and contraction of the overlying metal roof due to temperature changes and the like.

None of the prior art approaches have been able to provide an installation system for multiple skylights which accomplishes the goals of economy and simplicity of installation and which works equally well for new buildings and as retrofits in existing buildings.

SUMMARY OF THE INVENTION

The invention provides an upper diverter, used in a support structure on a sloping roof system, the roof structure defining a plurality of ribs, the support structure extending about an area of the roof, the support structure being so mounted on the ribs that the ribs provide the primary vertical support to the elements being supported by the support structure.

In a first family of embodiments, the invention comprehends an upper diverter, configured to be mounted on a sloping roof of a building, the upper diverter having a first length and comprising a lower flange, the lower flange having a second length extending along a substantial portion of the first length of the upper diverter, and an upstanding wall forming a joint with the lower flange at a lower edge of the upstanding wall, the joint extending generally along the second length of the lower flange, the upstanding wall extending upwardly from the joint to an upper edge of the upstanding wall, and wherein, in a view of the upper diverter taken from an angle perpendicular to the lower flange, lines representing the upper and lower edges of the upstanding wall converge.

In some embodiments, the upper edge of the upstanding wall has first and second ends, and the lower flange extends beyond at least one of the ends of the upstanding wall.

In some embodiments, the upstanding wall comprises an end wall defining a first projected angle, having a first magnitude relative to the lower flange, and a diversion web defining a second included angle, greater than the first angle, relative to the lower flange.

In some embodiments, the diversion web is located between the upper web and the lower flange.

In some embodiments, the width of the diversion web changes progressively along the length of the upper diverter.

In some embodiments, apparatus configured to form a support structure comprises a plurality of closures which, when assembled to such roof in cooperation with each other, define the support structure, and extend up from the roof, and wherein the support structure comprises an upper diverter of the invention.

In some embodiments, such apparatus is configured to be mounted to a metal roof of a building, wherein the roof comprises a plurality of metal roof panels, the metal roof panels having roof panel lengths and roof panel widths, and panel flats extending across the panel widths, the metal roof panels being arranged side by side, edges of adjacent such metal roof panels meeting at ribs defined by elevated rib structure portions thereof, the upper diverter being configured to extend across the width of at least one of the metal roof panels, the support structure further comprising first and second rail structures configured to be mounted on ones of the ribs of the metal roof panels such that the ribs provide primary vertical support for the support structure, with the first and second rail structures forming joints with the upper diverter, the support structure further comprising a lower closure configured to extend between respective ones of the rail structures across the width of the respective metal roof panel at a lower end of the support structure.

In some embodiments, the invention comprehends, in combination, a sloping roof system comprising a plurality of metal roof panels, each having a width, and opposing sides, and a roof panel length, and a panel flat extending across the roof panel width, between the opposing sides and defining a panel flat area, a given panel flat having a width, the metal roof panels being arranged side by side, adjacent each other, edge portions of adjacent ones of the metal roof panels defining elevated ribs on opposing sides of the respective metal roof panels, and a support structure configured to support a load from the sloping roof system, the support structure having a support structure width extending across the panel flat area of a single one of the widths of a such metal roof panel, and a support structure length extending along the length of the metal roof panel, the support structure extending about at least a portion of the panel flat of the respective metal roof panel, the support structure comprising an upper diverter of the invention, the upper diverter being configured to extend across the width of the respective metal roof panel, the support structure further comprising a first rail structure comprising one or more first rails arranged end to end with respect to each other, and mounted to a first such rib on a first side of the respective single one of the metal roof panels, and a second rail structure comprising one or more second rails arranged end to end with respect to each other, and mounted to a second such rib on a second opposing side of the respective single one of the metal roof panels, the first and second rail structures extending from a relatively upper portion of the support structure, at a relatively upper portion of the roof, toward a lower portion of the support structure at a relatively lower portion of the roof, the rail structures on the first and second sides of the metal roof panel forming first and second joints with the upper diverter at the upper portion of the support structure, and a lower closure closing the support structure at the lower portion of the support structure, the lower edge of the upstanding wall of the upper diverter defining a downwardly-directed slope extending across the width of the respective metal roof panel strip, thereby to direct water, flowing by gravity, laterally across the respective metal roof panel at the upper diverter.

In some embodiments, the upstanding wall comprises an upper web defining a first angle, having a first magnitude relative to the lower flange, and a diversion web defining a second included angle, greater than the first angle, relative to the lower flange, a lower edge of the diversion web defining a downwardly-directed slope extending across the width of the respective metal roof panel strip, thereby to direct water, flowing by gravity, laterally across the respective metal roof panel strip at the upper diverter.

In some embodiments, the invention further comprises an gap defining a path through a such rib at a side of the respective single one of the metal roof panels, at an elevation of the respective panel flat, the lower flange of the upper diverter and a portion of the upstanding wall extending along the path through the opening in the respective rib and to the panel flat of the adjacent metal roof panel, whereby water encountering the support structure at the upper diverter flows laterally across the panel flat, along the path through the respective rib gap and onto the panel flat of the adjacent metal roof panel.

In some embodiments, the rail structures are mounted to the ribs on opposing sides of the portion of the panel flat of the respective metal roof panel which the support structure extends about, such that the ribs are between lower edges of the rail structures and a portion of the panel flat which the support structure extends about.

In a second family of embodiments, the invention comprehends a building, comprising a building structural support system; building side walls; in combination, a sloping building roof overlying an area enclosed by the building side walls, the sloping roof having one of a high side and a ridge, and a plurality of roof apertures corresponding to passages extending from inside the building through the roof and wherein such passages extend, from a space inside the building, upwardly through the roof apertures; support structures extending about the apertures, the support structures extending up from the roof of the building and closing off access to the apertures from outside the building, from any side of a given such aperture; and skylight lenses overlying the support structures and closing off the apertures from access to the space inside the building, the skylight lenses, and correspondingly the support structures, being disposed at locations selected for desired distribution of daylighting inside the building, while occupying no more than 5 percent of an area of the roof overlying an area enclosed by the building.

In some embodiments, ones of the support structures are disposed at locations spaced from the high side or ridge such that the respective upper diverters are spaced from the high side or ridge, with panel flat portions between the high side or ridge and the respective ones of the upper diverters.

In some embodiments, the invention comprehends an upper diverter configured to be mounted on a sloping roof of a building, the upper diverter having a first length and comprising a lower flange, the lower flange having a second length extending along a substantial portion of the first length of the upper diverter; and an upstanding wall forming a joint with the lower flange at a lower edge of the upstanding wall, the joint extending generally along the second length of the lower flange, the upstanding wall comprising an upper web defining a first angle, having a first magnitude relative to the lower flange, and a diversion web defining a second included angle, greater than the first angle, relative to the lower flange.

In a third family of embodiments, the invention comprehends an upper diverter configured to be mounted on a sloping roof of a building, the upper diverter having a first length and comprising a lower flange, the lower flange having a second length extending along a substantial portion of the first length of the upper diverter; and an upstanding wall forming a joint with the lower flange at a lower edge of the upstanding wall, the joint extending generally along the second length of the lower flange, the upstanding wall comprising an upper web defining a first angle, having a first magnitude relative to the lower flange, and a diversion web defining a second included angle, greater than the first angle, relative to the lower flange.

In a fourth family of embodiments, the invention comprehends an upper diverter, configured to be mounted on a sloping roof of a building, the upper diverter having a first length and opposing first and second ends, and comprising a lower flange extending along a substantial portion of the first length; and an upstanding wall forming a joint with the lower flange at a lower edge of the upstanding wall, the joint extending generally along the second length of the lower flange, the upstanding wall having opposing first and second sides and extending upwardly from the joint to an upper edge of the upstanding wall, the upper edge of the upstanding wall having a third end corresponding to the first end of the upper diverter and a fourth end corresponding to the second end of the upper diverter, the lower flange being disposed on the first side of the upstanding wall, at least a portion of the upstanding wall, at the first end of the upper diverter, extending beyond the third end of the upper edge of the upstanding wall, a rib closure wall being disposed on the first side of the upstanding wall and extending from a locus at the fourth end of the upstanding wall, away from the upstanding wall, and upwardly above the lower flange, the rib closure wall having at least one panel thereof which is perpendicular to the upper edge of the upstanding wall.

BRIEF DESCRIPTION OF THE DRAWINGS

A more complete understanding of the present invention and the attendant features and advantages thereof may be had by reference to the following detailed description when considered in conjunction with the accompanying drawings wherein various figures depict the components and composition of the multiple skylight system.

Figure 1:
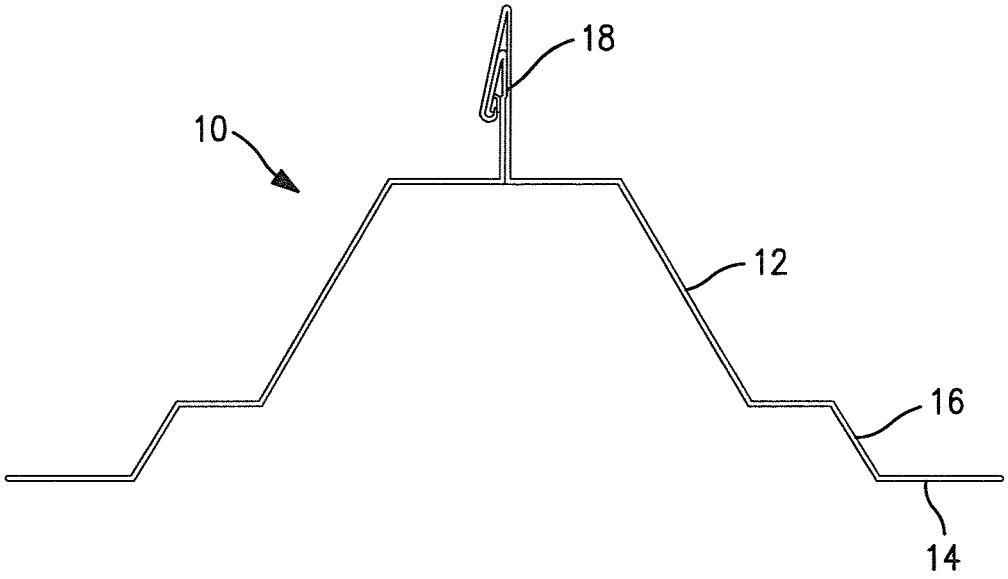
FIG. 1 is a roof profile of a metal roof of the type known as the standing seam roof panel.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

The products and methods of the present invention provide a roof adaptive system, as a load support structure, optionally a rail and closure structure, for use in installing various exterior roof loads, as well as structures which close off apertures in metal roofs. For purposes of simplicity, "roof penetrating structures" and "skylights" will be used interchangeably to mean various forms of roof structures installed on the upper surface of the roof and closing off roof apertures while providing for passage of light and/or ventilation, air handling, vents, air intake, air or other gaseous exchange to and/or from the interior of the building. In the case of roof ventilation, examples include simple ventilation openings, such as for roof fans, and smoke vents, which are used to allow the escape of smoke through the roof during fires. In the case of exterior loads on the roof, there can be mentioned, without limitation, such loads as air conditioners, air handlers, solar panels and other equipment related to building utilities, and/or to controlling water or air temperatures inside the building. The only limitation regarding the loads to be supported is that the magnitude of a load must be within the load-bearing capacity of the roof panel or panels to which the load is mounted.

The number of skylights or other roof loads can vary from one support structure, to as many support structures as the building roof structure can support, limited only by the amount of support provided by the surrounding roof surface structure, and with the support capabilities, e.g. at the ribs, being left largely intact during the installation process.

The roof adaptive system of the invention utilizes the beam strength of the major rib structures in the roof panels as the primary vertical support structure for mounting and fastening the e.g. skylight assembly to the roof and for supporting the e.g. skylight assembly on the roof. Typical conventional skylight installations do not allow for skylights to be mounted to each other, end to end, in continuous runs without intervening roof structure along the lengths of such runs. Rather, typical conventional skylight installations use a curb construction surrounding and supporting each skylight lens, the curb structure being typically 2-4 times wider than skylight support structure used in the present invention and 2-4 times wider than the roof panels on the roof.

The roof adaptive system of the invention does not require any structure underneath the roofing panels inside the building enclosure. Neither does the roof adaptive system of the invention require a separate curb construction to support or mount or attach each skylight to the roof. Rather, the roof adaptive system of the invention is overlaid onto, and mounted to, the roof panels at the standing ribs, and allows for thermal expansion and contraction of the roof adaptive system along with thermal expansion and contraction of the respective roof panel or panels by utilizing major profiles of the e.g. conventional metal roof panels for support. This is accomplished through direct attachment of the roof adaptive system of a skylight of the invention to the underlying ribs.

In reference now to the figures, the system allows the installation of two or more adjacent skylights in an end to end relationship along the major rib structure of a metal roof panel on the building.

The roof adaptive skylight systems of the invention can be applied to various types of ribbed roof profiles. FIG. 1 is an end view showing the roof profile of a metal roof of the type known as a standing seam roof. These include the "standing seam" roof, which has trapezoidal major ribs 12 typically 24" to 30" on center. Each roof panel 10 also includes a panel flat 14, and a shoulder 16 between the elevated ribs on the respective elongate sides of the panel, and the elevated ribs cooperate with corresponding elevated ribs on next-adjacent panels, thus forming standing seams 18. The rib elevations on respective adjacent panels are folded over to collectively create the standing seams, thus preventing water from penetrating the roof at the standing seams while creating an I-beam type strength effect at standing seam 18.

Figure 2:
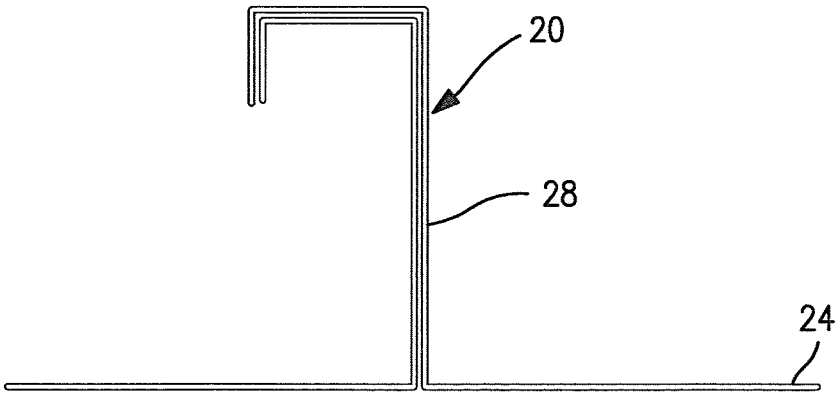
FIG. 2 is a roof profile of a metal roof of the type known as an architectural standing seam roof.

FIG. 2 is an end view showing the roof profile of a metal roof of the type known as an architectural standing seam roof, which uses a series of overlapping architectural standing seam panels 20. Each panel 20 comprises a panel flat 24, with an architectural standing seam 28 formed at the panel interconnections.

Figure 3:
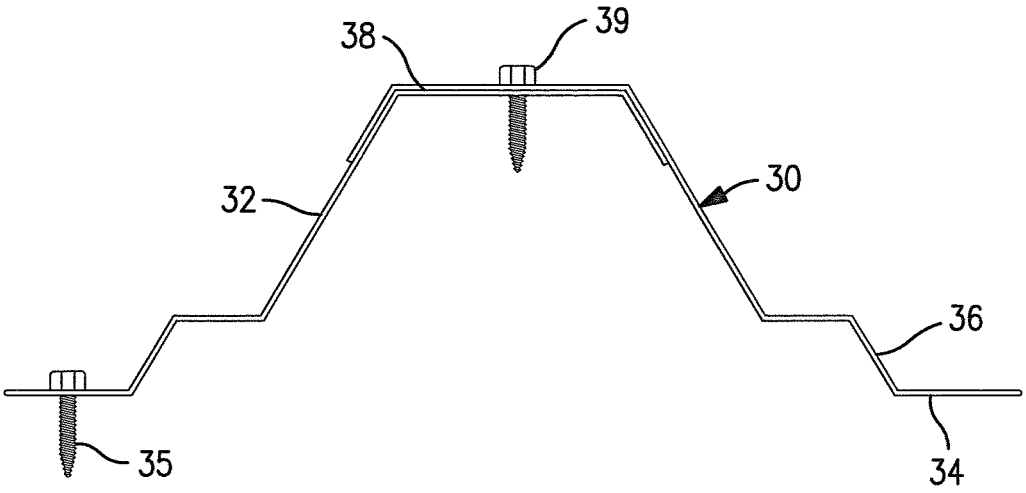
FIG. 3 is a roof profile of a metal roof of the type commonly referred to as an exposed fastener roof panel.

FIG. 3 is a view showing the roof profile of a metal roof of the type commonly referred to as an R panel or exposed fastener panel 30. Each panel has a rib 32, and a panel flat 34. Adjacent R panels are secured to the roof through structural fasteners 35. At shoulder 36, which is formed from overlapping regions, or at side lap 38, the adjacent panels are secured through stitch fasteners 39. Trapezoidal major ribs of the R panel roof are most typically formed at 8 inches to 12 inches on center.

Figure 4:
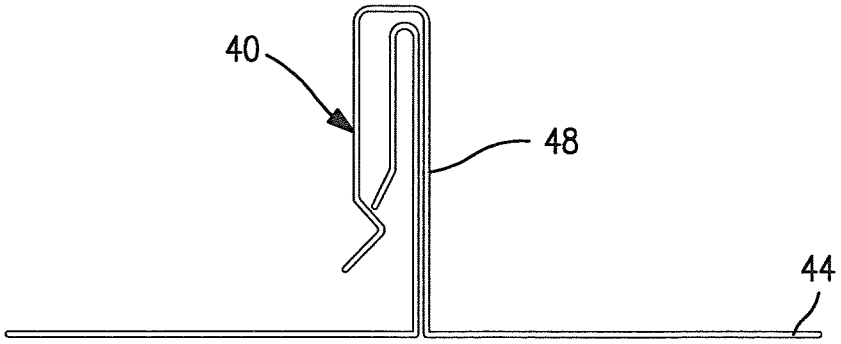
FIG. 4 is a roof profile of a metal roof of the type commonly referred to as a snap seam roof.

FIG. 4 is a view showing the roof profile of a metal roof of the type commonly referred to as a snap rib seam panel 40. Snap seam panels 40 have a panel flat 44 and a standing seam or snap seam 48 where the adjacent panels meet.

Figure 5:
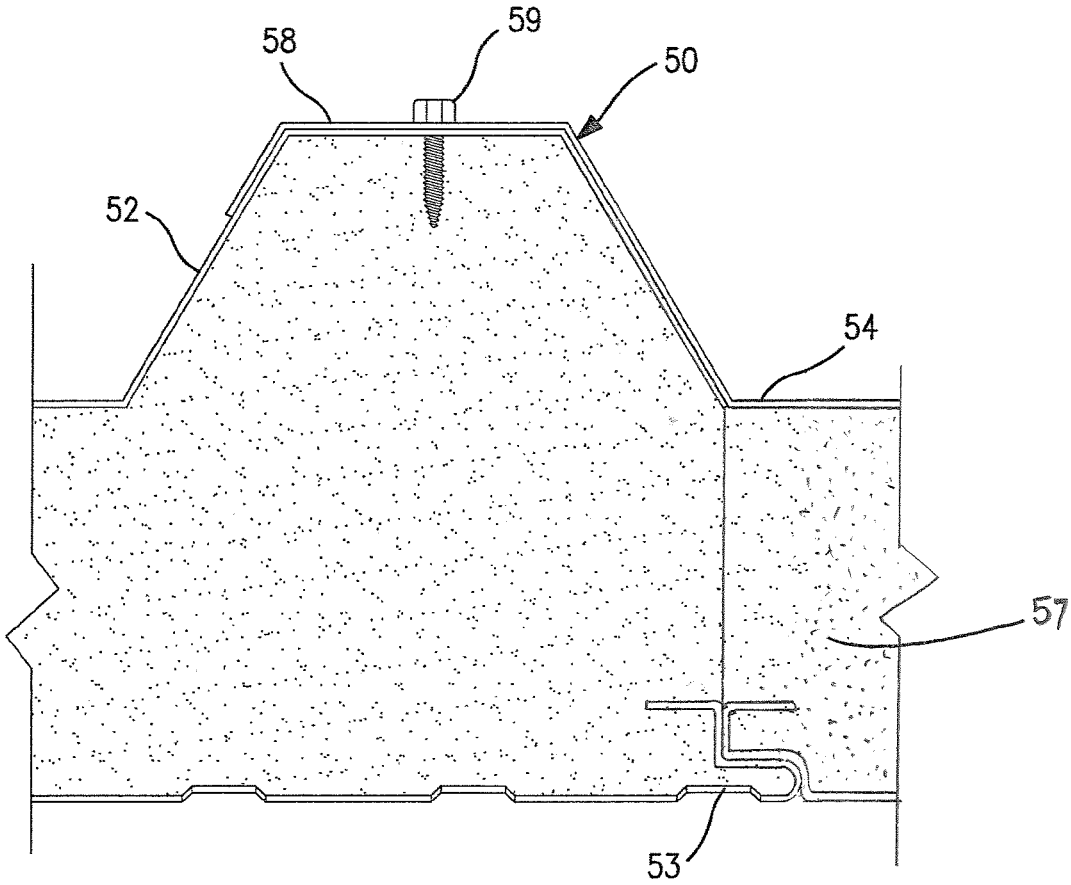
FIG. 5 is a roof profile of a metal roof of the type commonly known as foam core panel.

FIG. 5 is a view showing a roof profile of a metal roof of the type commonly referred to as using a foam core panel 50. Such roof has a rib 52, a liner panel 53, a panel flat 54 and a foam core 57. Side laps 58 are secured by stitch fasteners 59. Such roof panels are typically installed from the interior of the building.

A skylight/ventilation support structure is illustrative of roof-penetrating support structures of the invention, and includes a rail and closure structure adapted to be supported by the prominent elevations, seams, rib structures, or other structural elements of conventional such roof profiles, where the standing seam structure of the roof system, namely structure which extends above the panel flat, e.g. at seams 18 which mount adjoining exterior roof panels to each other, provides the support for the load support structures, and the roof-penetration closure structures, e.g. skylight/ventilation assemblies, are secured to the conventionally-existing elements of the roof structure, namely to the conventional metal roof panels, and overlie an opening formed largely in the intervening, non-structural roof flat region and without removing significant portions of the rib/seam/elevation structures.

Figure 6:
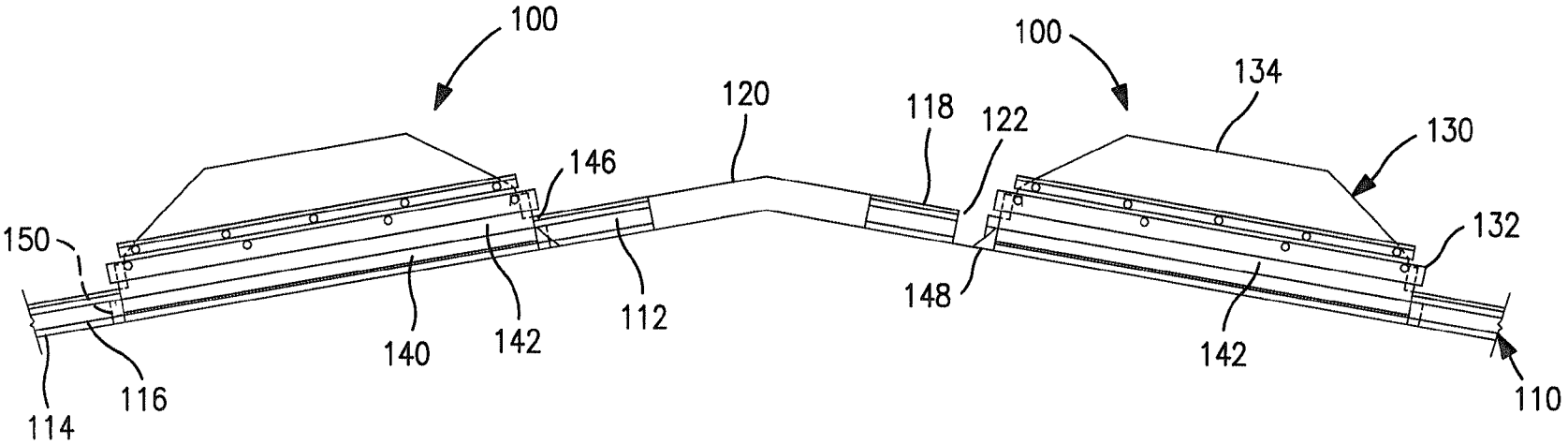
FIG. 6 is a side view showing major components of the system as installed in a metal roof.

Turning now to FIG. 6, there is shown two exemplified load support structures 100, overlain by skylight lens subassemblies, and attached to a standing seam panel roof 110. While FIG. 6 depicts such assembly, the components of the load support structures can be adapted, by shaping of the elements, for attachment to any roof system which has a profile which includes elevations, above the panel flat, which provide structure which provides structural support for the respective skylight or other roof-mounted assemblies or other roof-mounted loads.

Figure 7:
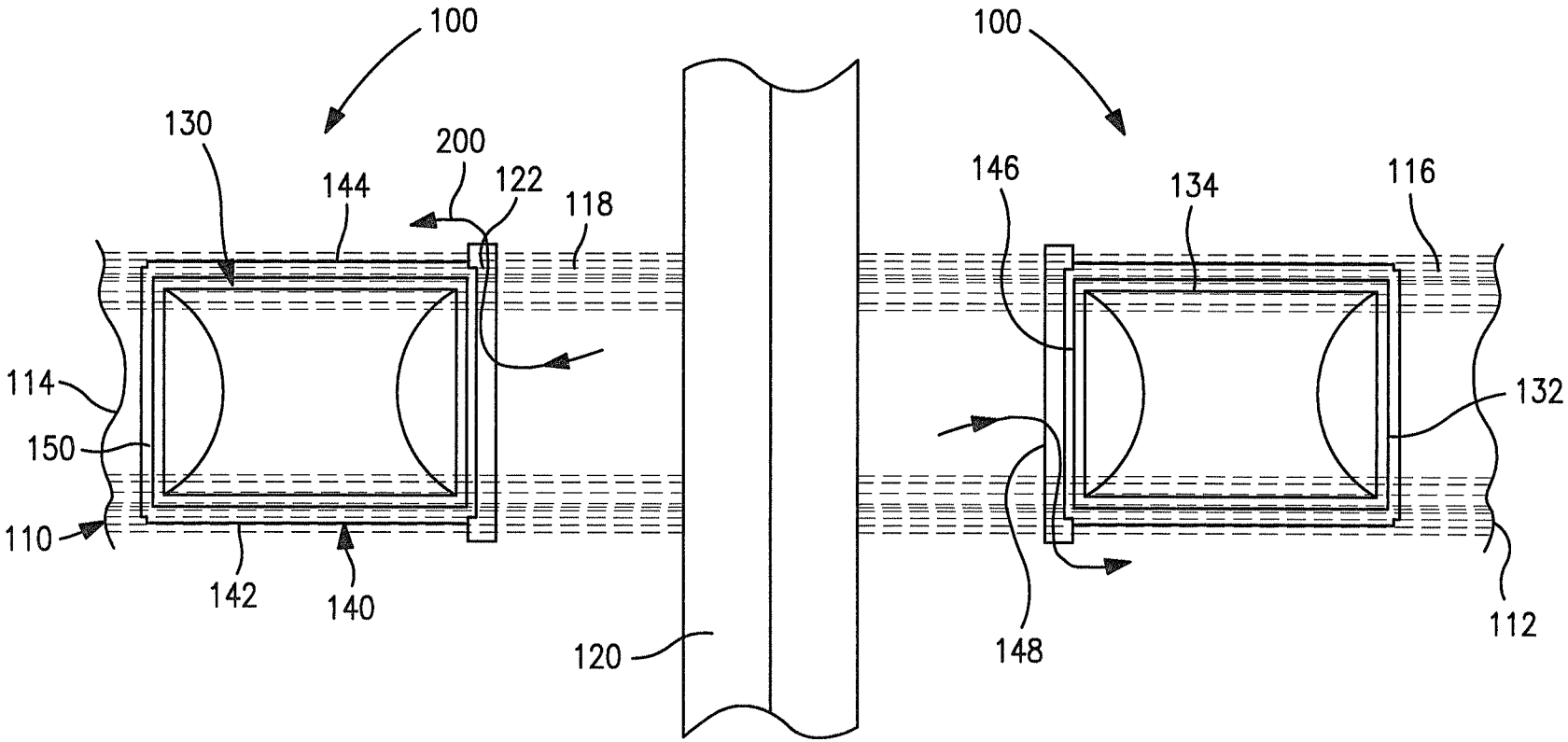
FIG. 7 is a top plan view of the in ailed system, showing the placement of skylights and the direction of water flow over the roof.

Looking again to the figures, particularly FIGS. 6 and 7, there is shown a portion of such a standing seam panel roof 110 having structural and other elements including a raised rib 112, a panel flat 114, shoulder 116 and standing seam 118. Given that water generally seeks the lowest level available, rib 112, shoulder 116, and standing seam 118 are all generally above the water line. Also depicted in FIGS. 6 and 7 are ridge cap 120 of the roof structure, and cutaway regions, or gaps 122 through the respective ribs 112, the gaps being formed to accommodate the closure structure, as described more fully following.

Shown as part of the system, and exemplified in this case, is a skylight lens subassembly 130, generally comprising a skylight lens frame 132 extending about the perimeter of an aperture in the roof, and a skylight lens 134.

While the figures depict a skylight, the rail structure, with or without end closures, can be used to mount a wide variety of loads on such roof, including various types of skylights, smoke vents, air conditioning, other vents, air intakes, air and other gaseous exhausts, electrical panels or switching gear, and/or other roof loads, including roof-penetrating structures, all of which can be supported on rail structures of the invention.

Again referring to FIGS. 6 and 7, the load support structure of the invention, as applied to a skylight installation, includes a rail and closure structure 140, generally comprised of side rails 142 and 144, an upper diverter 146 disposed adjacent the rib cutaway section, or gap 122 and a lower end closure 150. A sealing portion of the upper diverter may be located in gap 122, sealing the sides and bottom of the gap against water leakage into the building and carrying water laterally across the width of the respective rib, to the panel flat 114 of the adjacent roof panel, thus to transport the water away from the upper end of the skylight and to prevent the water from leaking through the roof opening.

FIG. 7 shows how gap 122 in roof rib 112 provides for water flow, as illustrated by arrow 200, causing the water to move laterally along the roof surface, over the sealing portion of the upper diverter, and down and away from the roof ridge cap 120 in panel flats 114 of roof panels which are adjacent the roof structures which support the respective e.g. skylights.

Lower end closure 150 closes off the roof aperture from the outside elements at the lower end of the e.g. skylight, thus to serve as a barrier to water leakage at the lower end of the roof opening.

Figure 8:
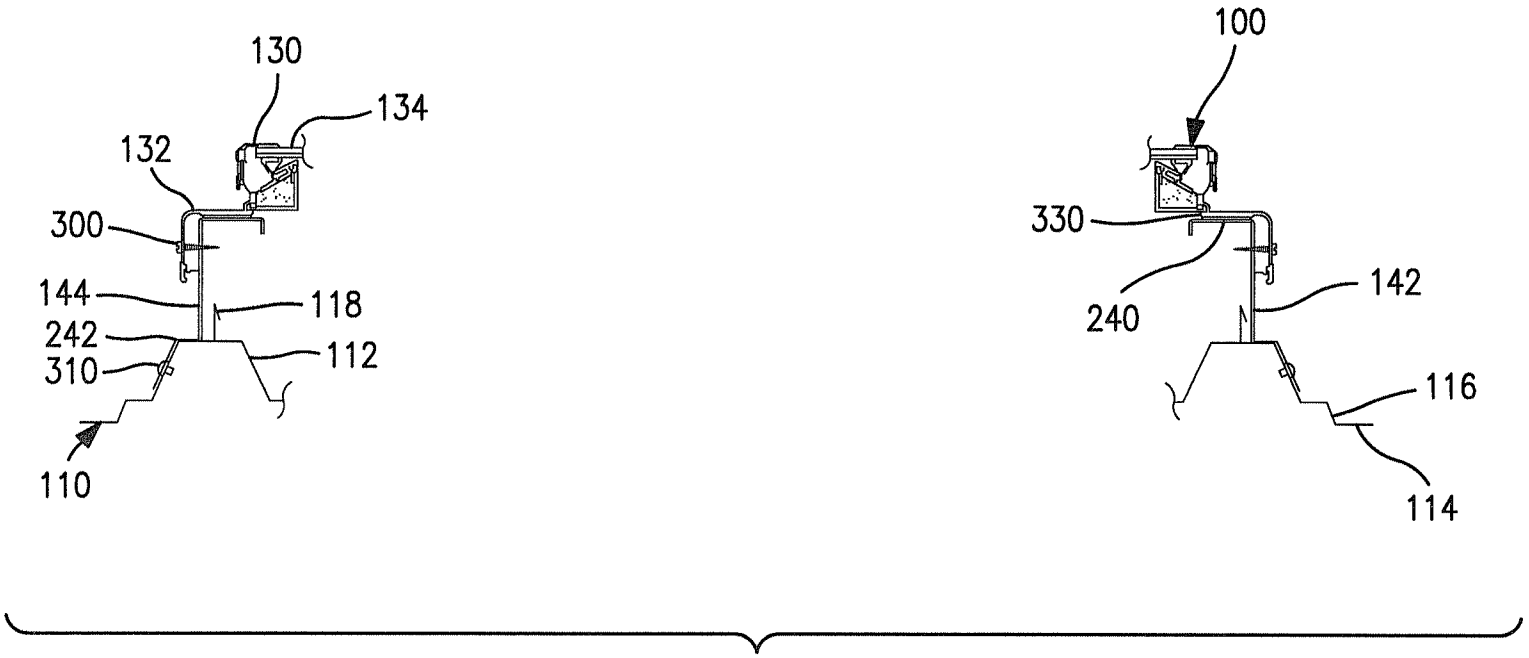
FIG. 8 is a cross section showing the connections of the skylight frame to the rail and closure structure, and the latter affixed over the surface of adjacent rib elevations of the metal roof.

Referring now to FIG. 8, a cross section through the load support structures 100 shows the securement of the structures 100 to standing rib portions of the standing seam panel roof 110. FIG. 8 depicts the use of ribs 112 to support the side rails 142 and 144 on opposing sides of the panel flat 114. Each rail 142 or 144 has a rail upper flange or bearing panel 240, rail bottom shoulder structure 242, and an upstanding riser portion between bearing panel 240 and rail shoulder 242. Skylight frame 132 is secured to rails 142, 144 by fasteners 300, only one of which is shown, spaced along the length of the rib.

As illustrated in FIG. 8, rail bottom shoulder structure 242 is shaped to fit closely over the outside of the roof rib elevation 112 adjacent the roof penetration, over the length of the respective side rail, The bottom shoulder structure engages the rib elevation adjacent the roof penetration over substantially the entire length of the side rail, and is secured directly to the respective roof rib elevation 112 by e.g. rivets 310, only one of which is shown, spaced along the length of the rib. The rib elevation thus provides structural support for the side rail over substantially the entire length of the side rail. The riser portion extends upwardly from the rib elevation proximate the bottom shoulder. Rail bearing surface 240, at the top of the rail, supports skylight frame 132. A sealant 330 is disposed between bearing surface 240 and skylight frame 132, to seal against the passage of water or air across the respective joint.

Rail and closure structure 140 is representative of load support structure 100 and can be produced to fit closely along the contour of roof 110, and can be so configured to have end portions that match the cross-panel contours of the respective ribs 112 as well as the corresponding panel flats 114. The various mating surfaces of structure 140 and roof 110 can be sealed in various ways known to the roofing art, including caulking or tape mastic, or various rubber fittings or inserts can be used to seal around the open area of the aperture in the roof.

Figure 9:
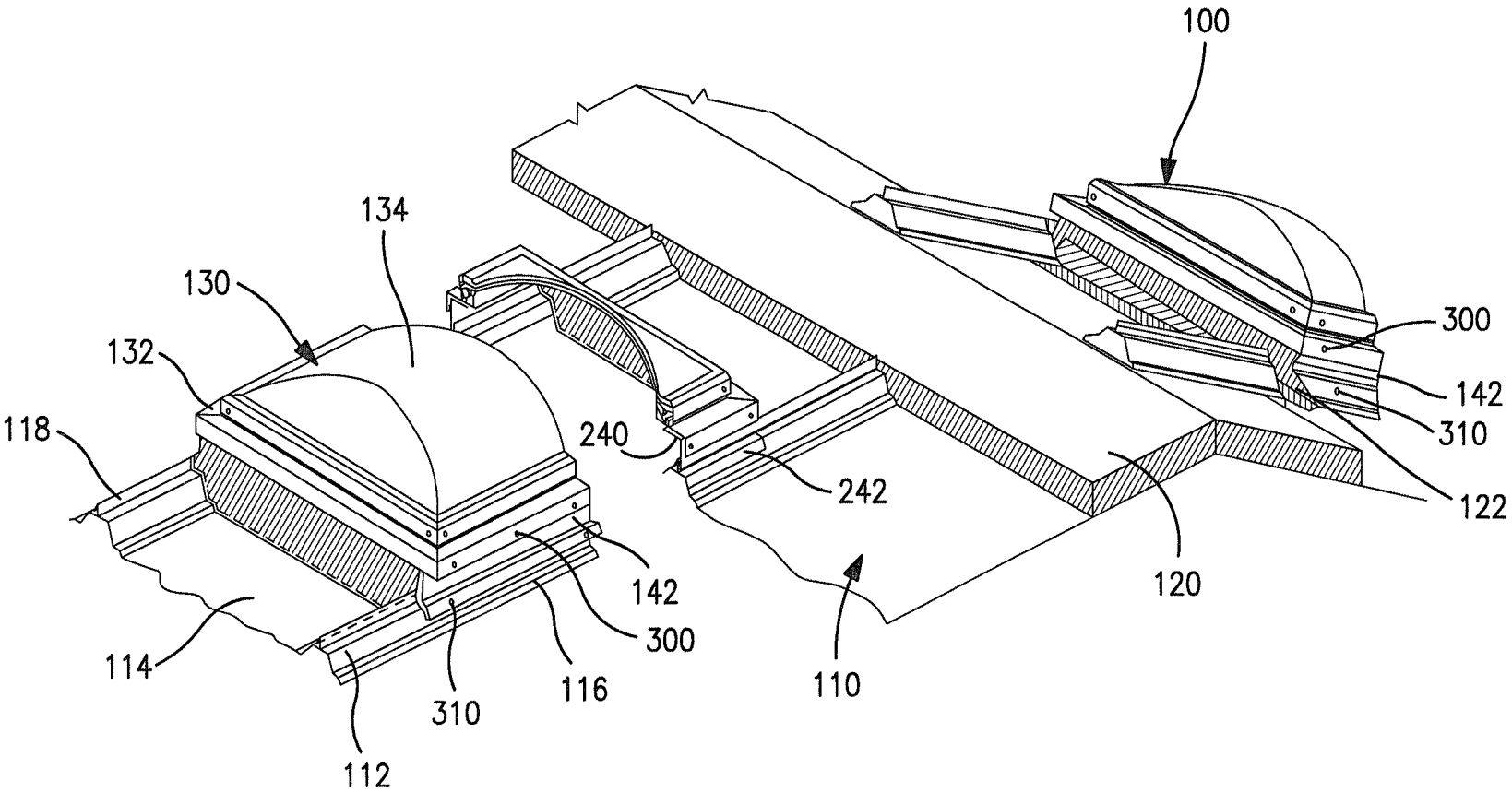
FIG. 9 is a perspective view partially cut away showing internal structure of the system as installed on the rib elevations of a metal roof.

In FIG. 9 a partially cut away perspective view of rail and closure structures 140 is used to show support of the rail and closure structure by standing seam panel roof 110, particularly the elevated rib 112 providing the structural support through the standing seams. FIG. 9 illustrates how the rail and closure structures interface with the structural profiles of the roof panels of the metal roof structure, and incorporate the elevations and ribs used in sealing adjacent ones of the panels, to provide the primary support, by the standing seams, for the loads imposed by the skylights. In this fashion, the load support structures of the invention adopt various ones of the advantages of a standing seam roof, including the beam strength features of the ribs at the standing seam, as well as the water barrier features of the standing seam.

Most standing seam roofs are seamed using various clip assemblies that allow the roof panels to float/move relative to each other, along the major elevations, namely along the joints between the respective roof panels, such joints being defined at, for example, elevated ribs 112, whereby each roof panel is free to expand and contract according to e.g. ambient temperature changes irrespective of any concurrent expansion or contraction of the next-adjacent roof panels. Typically, a roof panel is fixed at the eave and allowed to expand and contract relative to a ridge. In very wide roofs, the panels can be fixed at midspan, whereby the panels expand and contract relative to both the eave and the ridge.

The design of the skylight system of the invention takes advantage of the floating features of contemporary roofing structures, such that when skylight assemblies of the invention are secured to respective rib elevations as illustrated in e.g. FIGS. 8 and 9, the skylight assemblies, themselves, are supported by the roof panels at ribs 112, and thus move with the expansion and contraction of the roof panels to which they are mounted.

FIG. 9 shows panel flat 114, rib 112, and shoulder 116, as well as standing seam 118. Ridge cap 120 is also shown, as well as the gap 122 in a rib 112; and a section of panel flat 114 is shown between ridge cap 120 and the upper end of rail and closure structure 140.

Skylight subassembly 130 is supported by ribs 112, on rail and closure structure 140, as previously described.

Skylight frame 132 is secured by a series of fasteners 300 to rail and closure structure 140 at side rails 142 and 144 and rails 142 and 144 are secured to ribs 112 by a series of rivets 310.

In application, for each rail and closure structure 140, a short length of a single rib 112 is cut away, forming a gap 122 in the respective rib, to accommodate drainage at the upper end of the rail and closure structure (toward ridge cap 120). Such gap is typically used with standing seam, architectural standing seam and snap seam roofs. Two ribs may be cut, such as for roofs having an "R" panel profile.

The retained portions of rib 112, namely along the full length of the skylight as disposed, along the length of the respective roof panel, provide beam-type structural support by way of standing seam 18, supporting side rails 142 and 144 and maintaining the conventional watertight seal at the joints between roof panels 10, along the length of the assembly. Internal elevations of ribs 112, namely toward the opening, may be removed to allow additional light from skylight lens 134 to reach through the respective roof opening.

A bearing plate structure 148, illustrated in FIG. 7 and following the width dimension contour of the roof panel, is placed under the respective roof panel at or adjacent the upper end of the aperture in the roof. Fasteners are driven through a high end diverter, described further hereinafter, through the roof panel and into bearing plate structure 148, drawing the diverter, the roof panel, and the bearing plate structure close to each other and thus trapping the roof panel closely between the bearing plate and the diverter and closing off the interface between the panel and the diverter. Caulk or other sealant can be used to further reinforce the closure/sealing of that interface.

Bearing plate 148 can also be used to provide lateral support to link adjacent rib elevations 112 to each other, and is typically produced of steel or other material of sufficient rigidity to provide a rigid substructure support to the rail and closure structure at the high end of the rail and closure structure.

Rail and closure structure 140 is shaped in such a manner that the skylight subassembly can be easily fastened directly to the rails with rivets or other fasteners such as screws and the like as illustrated at 310 in FIG. 8.

Figure 10:
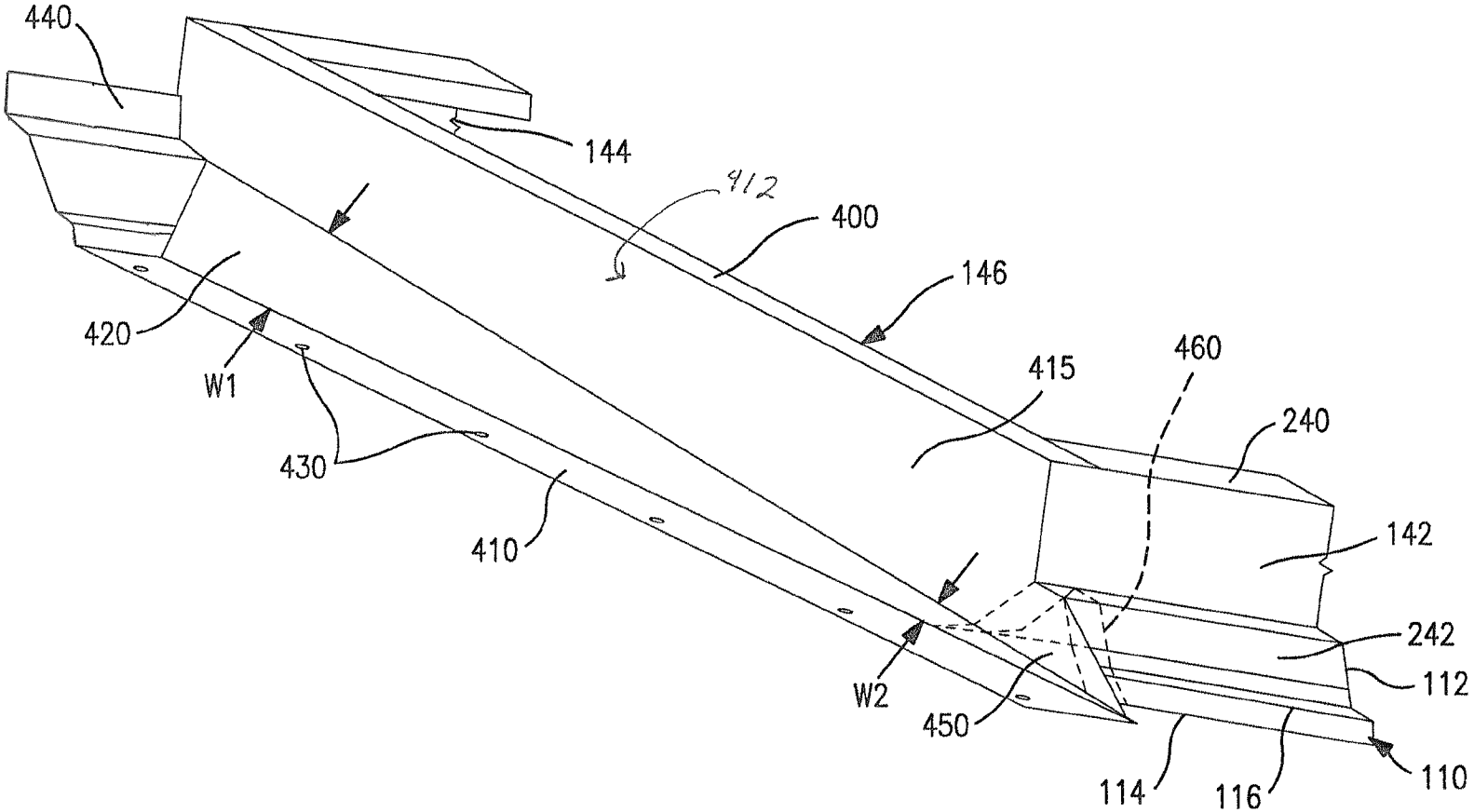
FIG. 10 is a perspective view of the upper diverter of the rail and closure structure.
Figure 11:
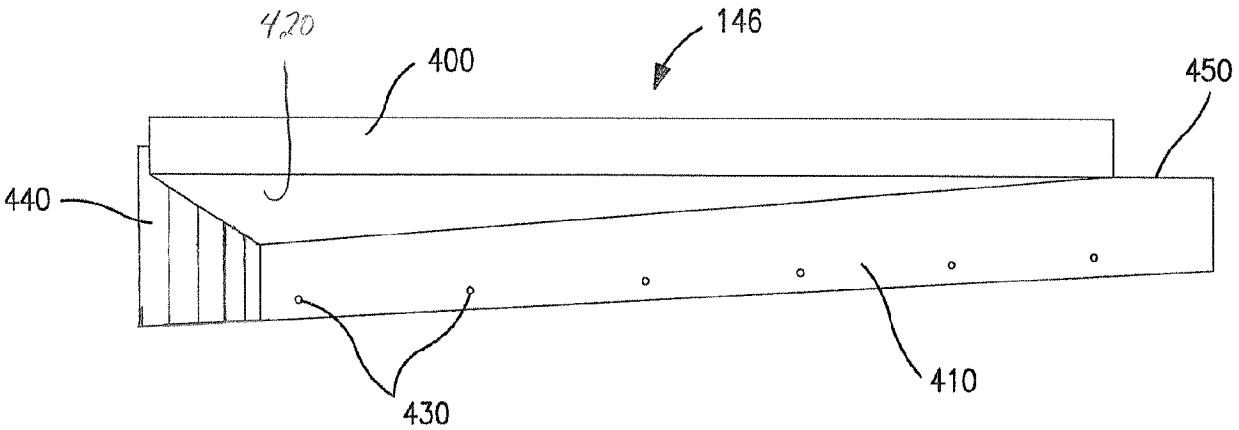
FIG. 11 is a top view of the upper diverter of the rail and closure structure.
Figure 12:
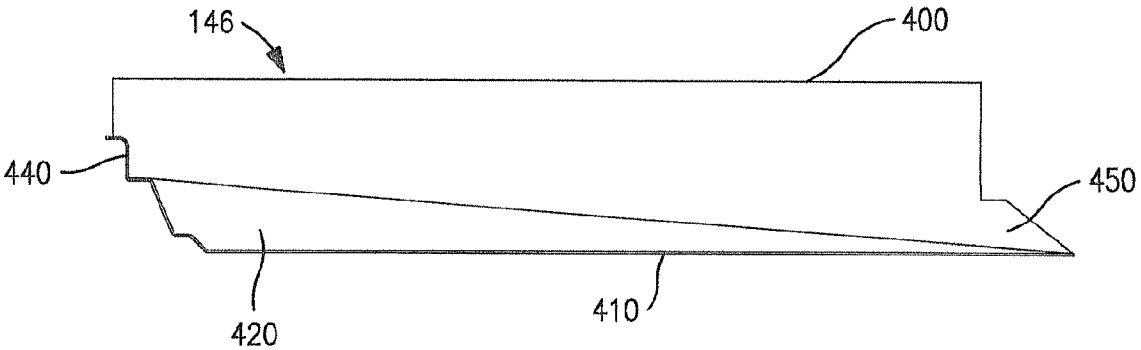
FIG. 12 is a front view of the upper diverter of the rail and closure structure.

Looking now to FIGS. 10 through 12, an upper diverter 146 provides end closure of the roof opening at the upper end of the roof opening, and diverts water around the upper end of the assembly, to the panel flat portion 114 of an adjacent roof panel. Diverter 146 also provides a weather tight seal at the upper end of the assembly, as used with plate 148 (shown in FIG. 6) in combination with conventional sealant materials. In reference to side rails 142 and 144 of a standing seam panel roof 110, diverter 146 generally fits the profile of the uncut rib 112 across the panel flat from the cut away gap 122. The upper ends of side rails 142 and 144 abut, and form joints with, the downstream side of diverter 146 and the height of diverter 146 matches the heights of the side rails. Upper flange 400 of diverter 146 acts with upper flanges 240 of side rails 142 and 144 to form the upper surface of the rail and closure structure, to which the skylight lens frame is mounted, as well as surrounding a top opening in the rail and closure structure, which overlies the corresponding opening in the roof panel.

Lower flange 410 of diverter 146 runs along, and parallel to, panel flat 114 of the respective roof panel. Upstanding wall 412 extends upwardly between lower flange 410 and upper flange 400. Diverter 146 also has a diversion surface 420, and fastener holes 430 along lower flange 410. Diversion surface 420 is, without limitation, typically a flat surface defining first and second obtuse angles with lower flange 410 and upper web 415. Upstanding wall 412 includes upper web 415 and diversion surface 420. Upper web 415 defines a first projected angle, having a first magnitude relative to the lower flange, and a diversion web 420 defining a second included angle, greater than the first angle relative to the lower flange.

Diversion surface 420 has relatively greater width "W1" on the side of the closure structure which is against the rib which is not cut, and a relatively lesser width "W2", approaching a nil dimension, adjacent rib gap 122, thus to divert water toward gap 122.

At that end of lower flange 410 which is closer to the closed rib is a rib closure wall 440, disposed on the same side of upstanding wall 412 as the lower flange, and extending from a location at the upstanding wall, away from the upstanding wall and upwardly above the lower flange, the rib closure wall having at least one panel thereof which is perpendicular to the upper edge of the upstanding wall.

At the end of lower flange 410 which is closer to the cut rib is a rib sealing portion 450 of upper web 415, which functions to divert water across the respective rib 112 and onto the flat portion of the adjacent roof panel. Rib sealing portion 450 extends through gap 122 in the respective rib at the panel flat elevation. Optionally, a rib plug 460, along with suitable sealant, is inserted into the rib on both the upstream side, and optionally on the downstream side, of the rib at gap 122, thus to provide a closure in the cut end of the rib. Accordingly, water which approaches the high end diverter is diverted by diversion surface 420 and flange 410 toward sealing portion 450, thence through the gap 122 in the rib, away from the upper end of load support structure 100 and onto the panel flat portion of the next laterally adjacent roof panel.

Figure 13:
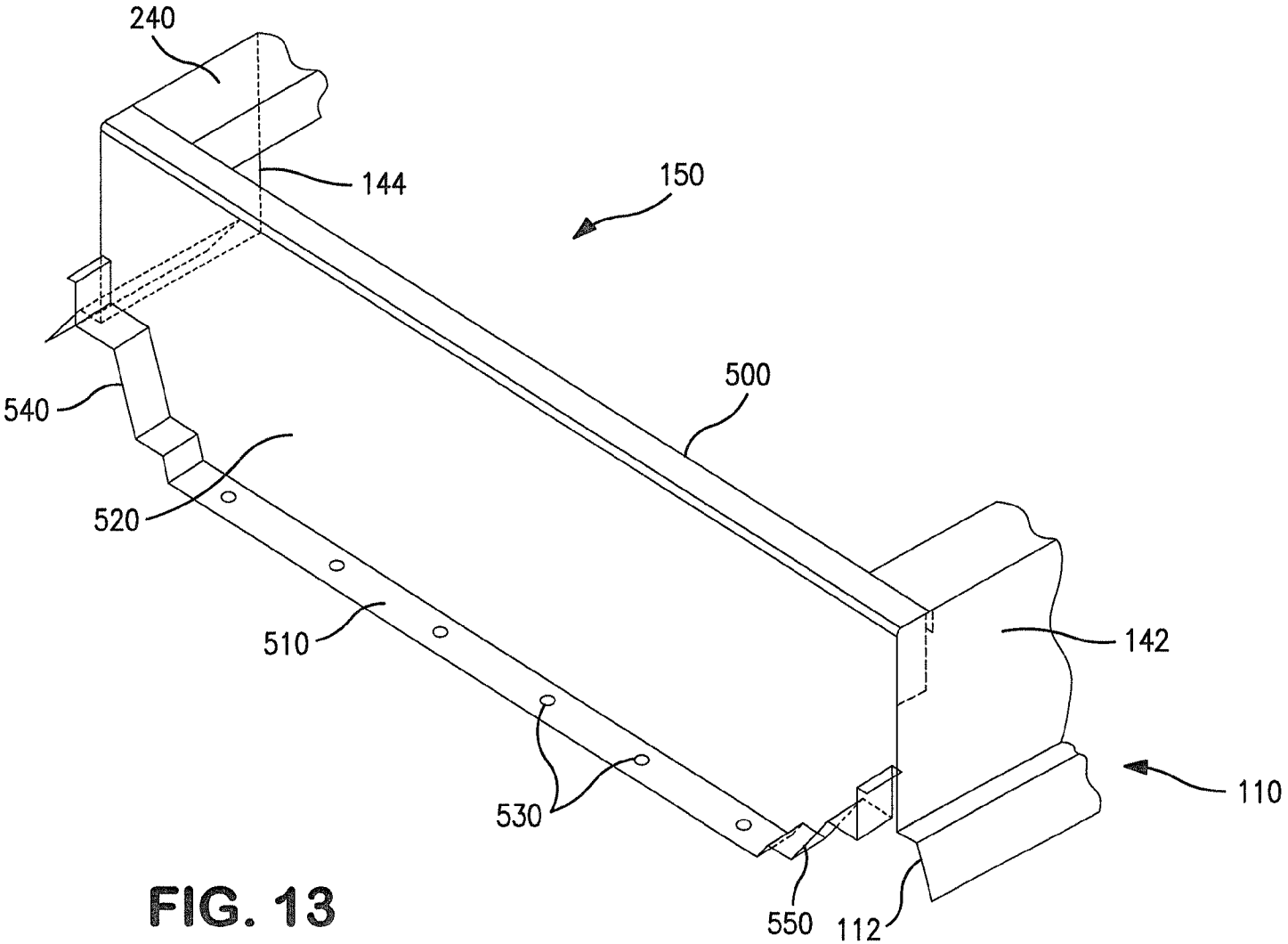
FIG. 13 is a perspective view of the lower closure of the rail and closure structure.
Figure 14:
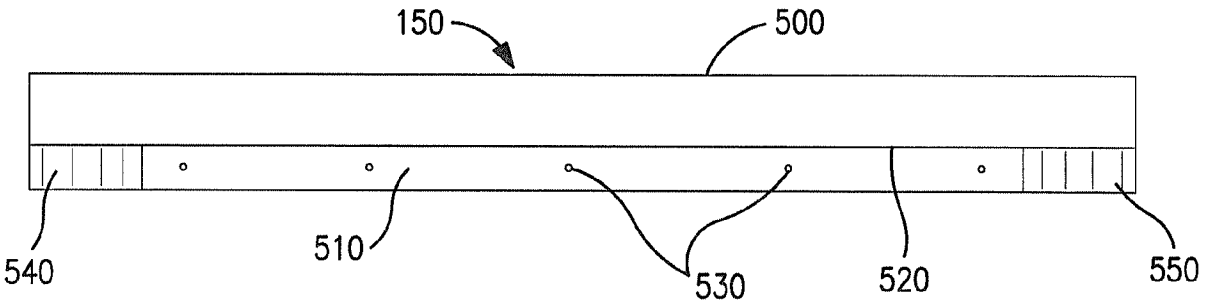
FIG. 14 is a top view of the lower closure, of the rail and closure structure.
Figure 15:
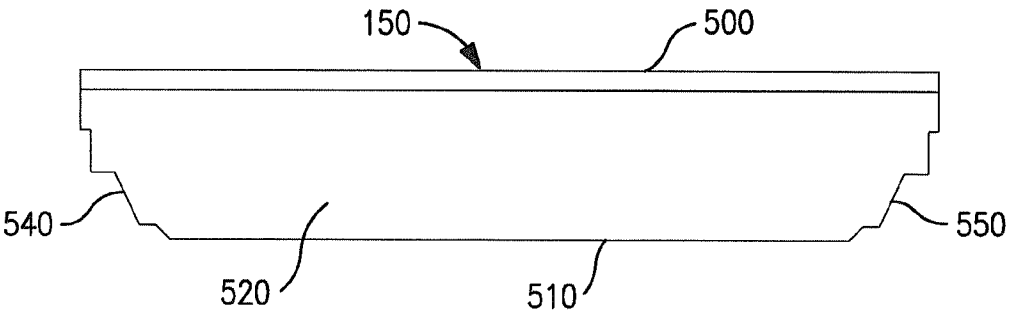
FIG. 15 is a front plan view of the lower closure of the rail and closure structure.

FIGS. 13 through 15 show lower closure 150, which is used to maintain a weather tight seal at the lower end of rail and closure structure 140. Shown again in reference to side rails 142 and 144 of a standing seam panel roof 110, the bottom of closure 150 is contoured to fit the profiles of the ribs 112 as well as to fit the contour of panel flat 114. Side rails 142 and 144 abut bottom closure 150 and the height of closure 150 matches the heights of side rails 142, 144.

Lower closure 150 has an upper flange 500 and a lower flange 510, as well as a closure web 520. Lower flange 510 includes fastener holes 530. Collectively, the top flanges of side rails 142, 144, bottom closure 150, and high end diverter 146 form a common top surface of the rail and closure structure, which receives the skylight lens subassembly.

Closure 150 includes rib closure walls 540 and 550 to provide tight fits along ribs 112.

Figure 16:
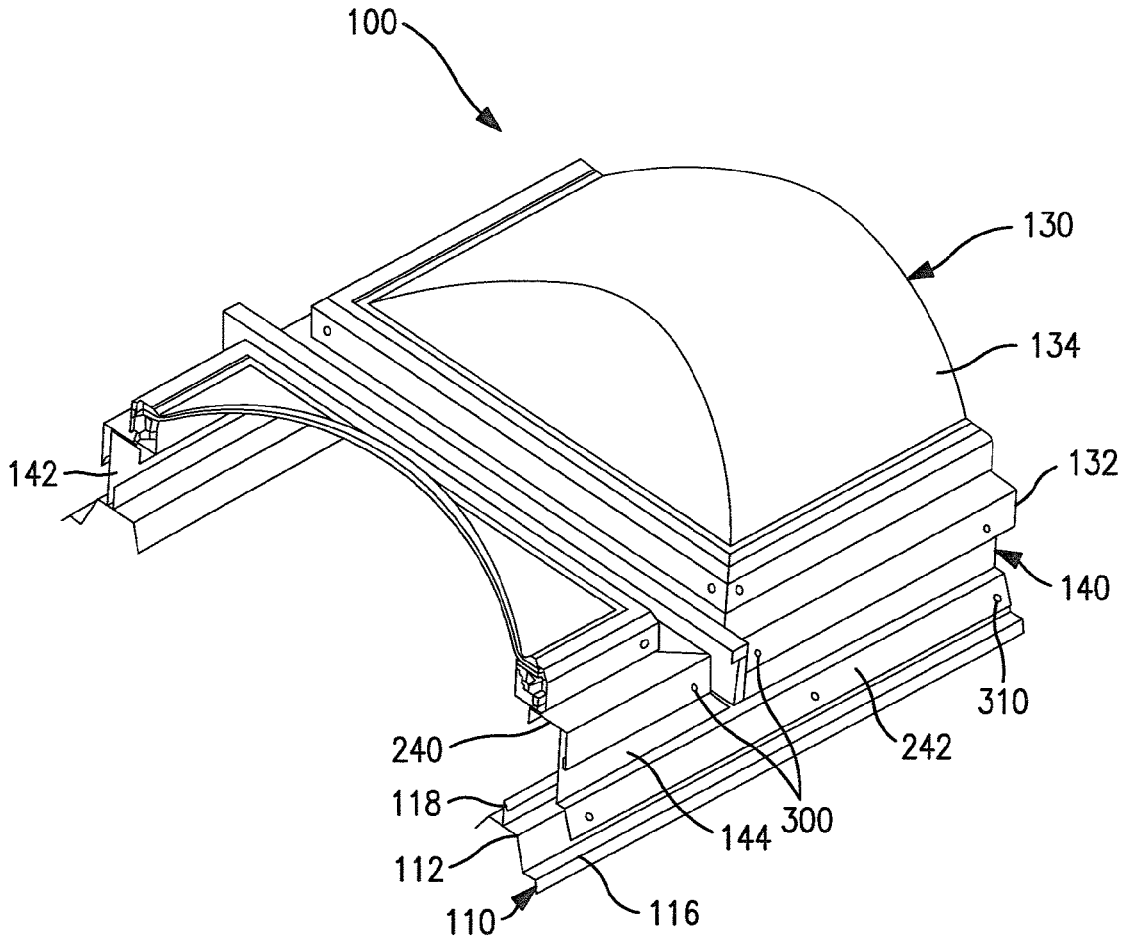
FIG. 16 is a perspective and partially cut away view showing a connection of adjacent skylights of the system.
Figure 17:
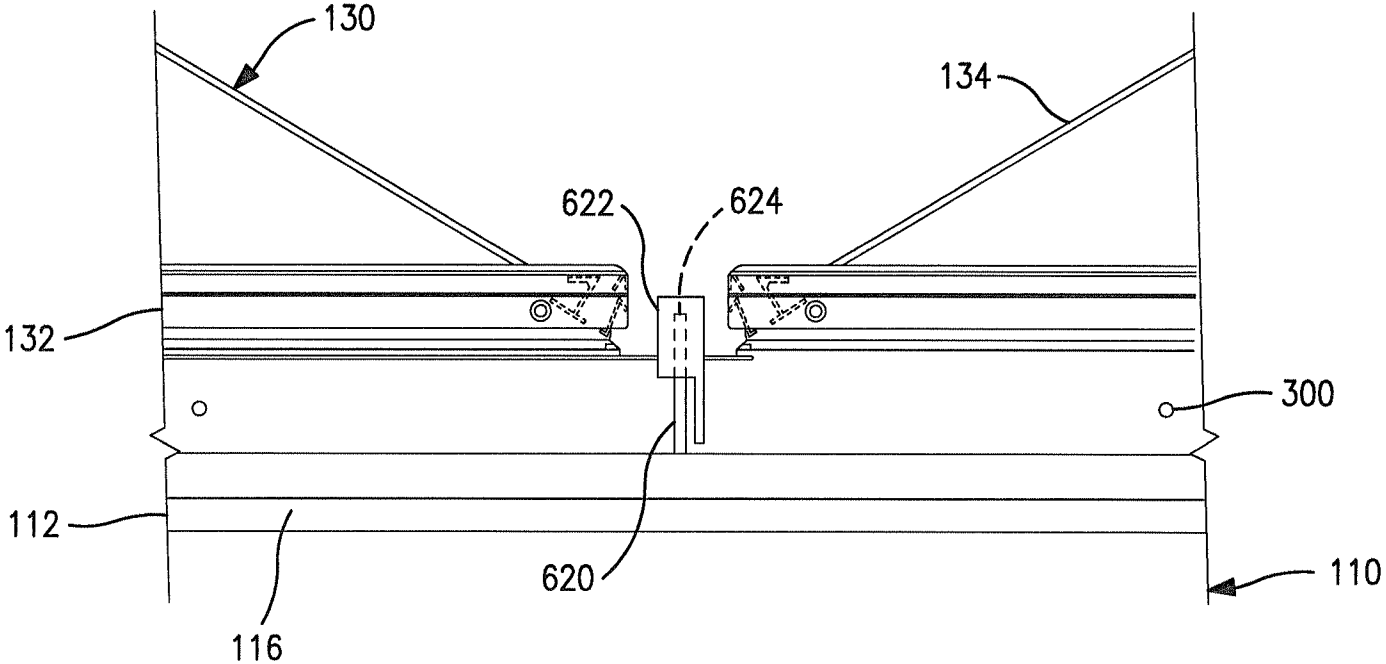
FIG. 17 shows additional detail of how the adjacent skylight ends are joined to each other.

Looking now to FIGS. 16 and 17, the adaptation of load support structures 100 of the invention for supporting multiple skylight units over a single aperture in the roof, is shown. A chief aspect of load support structures 100 is the reduction in the number of roof penetrations, namely roof apertures, required to provide daylight lighting to the interior of e.g. a building, as multiple skylight assemblies can be mounted along the length of a single elongate opening in the roof, whereby fewer, though longer, openings can be made in the roof to achieve a given opening area for entrance of daylighting into the building. Namely, a single opening in the roof can extend along substantially the full length of a single rib, if desired, rather than cutting multiple smaller openings along that same length, and thereby providing for an equal or greater quantity of ambient light being brought into the building through a smaller number of roof openings.

In the case of standing seam roofs, the load support structures of the invention provide the ability to remove only a portion of the bottom flat portion of a given metal roof panel. This maintains the structural integrity of the roof panel by avoiding removal of multiple sections of major panel elevations in adjacent roof panels, as is done to accommodate a "conventional" curb assembly which spans multiple roof panels. Thus, the structural integrity of the roof, as defined by the roof panels, is not as greatly compromised and there are fewer potential openings for water infiltration, in that the upper reaches of the skylight panels can be mounted in the roof adjacent the ridge of the building and can extend to the eave, requiring water to be diverted only once near the ridge of the roof plane and only across one panel flat.

To the limited extent that gaps are cut in the elevations/ribs, such gaps extend along only minimal lengths of the respective ribs, on the order of a few inches or less, solely for the purpose of allowing drainage around the upper ends of the rail and closure structures.

The rails, with or without the upper diverter or the lower closure, depending on the presence, or not, of an opening in the roof, can be installed on major rib elevations for any of the aforementioned roof panel profiles relative to the included flat portion of the respective roof panel, so long as the rib structure can adequately support the contemplated load. When the upper diverter and lower closure are included in defining a such rail and closure structure, each of the major structural elements closing off side access to the enclosed space, namely rails 142, 144, diverter 146, and lower closure 150, operates as a "closure" closing off access to the enclosed space, from the respective side of the enclosed space.

The load support structures of the invention are particularly useful for continuous runs of e.g. skylights, where individual skylights are arranged end to end between the ridge and the eave of a roof. FIGS. 16 and 17 show how two adjacent skylight assemblies 100 can be affixed to each other along a standing seam roof 110. Instead of installing a high end diverter and a lower closure with each of multiple skylight assemblies, the adjacent rail and closure structures, which support adjacent ones of the skylight assemblies, abut each other. Each skylight assembly has a male flange 620 extending across the width of the skylight assembly at one end of the assembly and a female flange 622 at the opposing end of the assembly. For runs of multiple skylight assemblies, disposed end to end as illustrated in FIGS. 16 and 17, female flange 622 is mounted over male flange 620, whereby male flange 620 is received inside cavity 624 of the female flange. Caulk or other sealant can be used to seal such closure/cavity.

As a non-limiting example, skylights can be produced in units of up to, for example and without limitation, 10 feet long, and connected end to end for as long a distance as necessary to cover the aperture in the roof, as each skylight unit is supported by the ribs 112 of the respective roof panel. The standing rib elevation (the major corrugation) extends longitudinally along the full collective lengths of the sides/rails of the respective rail and closure structures 140, regardless of the number of skylight assemblies which are used to close off a given opening in the roof. Water cannot enter over the top of the rail and closure structure because of the sealant at 330. Water cannot enter at the upper diverter because of the seal properties provided by the upper diverter, by bearing plate 148, and by the respective sealants, as well as because of the diversion of water away from the upper end of the rail and closure structure through gap 122. Similarly, water cannot enter at the lower end of the rail and closure structure because of the seal properties provided by the lower closure and by the sealants between the lower closure and the respective roof panels. Where the skylight assembly starts at the ridge of the roof, a flashing can be inserted under the ridge cap and extended to the upper diverter.

Where the ridge cap has a configuration to fit the rib elevations (major corrugation) in the roofing panels, a portion of the rib, in the ridge cap, may be cut out (approximately 2 inches as in all rib cutting discussed elsewhere herein), allowing the water from the roof above the cut to be diverted laterally, sideways onto the next adjacent roof panel, as across sealing portion 450 and thus across the rib.

If desired, side-by-side rails 142, 144 can be increased in height to increase the distance/height between an upper portion of the rail and closure structure and the respective underlying roof panel. In the alternative, a height extension rail can be laid over or attached to the top of the rail and closure structure to provide a corresponding height increase. Such an extension can be produced to rest along the upper flange of the rail and closure structure, to effectively raise the height of the skylight or smoke vent to accommodate different depths or other design features of the respective skylights, smoke vents, or other roof loads, or to accommodate snow conditions, anticipated snow depths, and the like. In this fashion, the rail and closure structure can be produced to a standard height, with varying extensions used to elevate the overall height of the structure for such varied purposes. Various forms for such an extension can be suitable, and the skilled artisan will understand various ways and means of designing and manufacturing such extension to accomplish the goal of added elevation for the skylight lens.

As indicated above, the weight of the loads transferred by rails 142, 144 is transferred directly to ribs 112 of the respective underlying roof panels along the full lengths of the load support structures; and only a minor portion of that weight is borne by the panel flat, and only at the high end and at the lower end of a load which overlies an opening in the roof, and wherein such opening can underlie e.g. multiple skylight units. Thus, the weight of the rails, or the rail and closure structure, is borne by the strongest elements of the roof panels. Specifically because the weight is borne directly by the panel ribs, a wide variety of roof-mounted loads, in addition to skylights and smoke vents, is contemplated to be mounted on rails 142, 144. Where the load overlies an opening in the roof, the rail system provides for fewer opening. Where the load does not overlie an opening in the roof, the rail system, optionally without upper diverter 146 or lower closure 150, allows the roof to carry the weights of a variety of loads without penetrating the roof for the purpose of extending the support path through openings in the roof to the underlying building structural members, also without adding framing or other bracing under the roof panels to support the weight of such roof-mounted hardware, and thus avoiding water leaks associated with such openings, so long as the weights of such roof-mounted loads do not exceed the allowable load on the ribs. And where a roof-mounted load is e.g. an air conditioner, namely a load which does not require a roof opening, the upper diverter and the lower closure can be omitted.

The primary reason why the disclosed rail and closure structures do not leak is that a great portion of the perimeter of the closure, namely that which is defined by side rails 142, 144, is above the panel flat, namely above the water lines on the roof panels. With no standing water at the joints between the rails and the roof panels, even if the sealant fails at the joint, the heights of those joints above the water line means that no water routinely enters such failed joint.

As a general statement, rail and closure structures of the invention close off the roof aperture from unplanned leakage of e.g. air or water through the roof aperture. The rail and closure structure 140 extends about the perimeter/sides of any such roof opening and extends from the roof panel upwardly to the top opening in the rail and closure structure. The lens subassembly overlies the top opening in the rail and closure structure and thus closes off the top opening to complete the closure of the roof aperture.

Load support structure 100 thus is defined by rail and closure structure 140 about the perimeter of the roof opening and by skylight lens subassembly 130, or the like, over the top of the rail closure structure and thus over the top of the roof opening.

Although the invention has been described with respect to various embodiments, this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A metal panel roofing system, comprising:

at least one roof eave, a roof ridge, roofing panels extending from the at least one roof eave to the roof ridge, said roofing panels forming a roof having rib elevations extending in parallel relation from the roof eaves toward the roof ridge and panel flats between said rib elevations, a roof penetration in at least one panel fiat of the roof between two of the rib elevations, side rails mounted directly to the rib elevations adjacent said roof penetration, wherein each side rail has a length and is comprised of an upstanding riser portion, an upper flange extending from said upstanding riser portion, and a bottom shoulder structure for engaging the rib elevation of the roof adjacent such roof penetration over the length of said side rail, and the riser portion of said side rail extends upwardly from the rib elevation over the length of said side rail, wherein, when said side rails are so mounted to said rib elevations, said side rails extend in the directions of said rib elevations and engage said rib elevations over substantially the entire lengths of said side rails, and wherein said rib elevations provide structural support for said side rails over substantially the entire lengths of said side rails, and a skylight or other structure mounted to said side rails over said roof penetration.

2. The roofing system of claim 1 wherein the rib elevations of the roofing system have a cross-sectional profile, and wherein the bottom shoulder structure of each side rail is shaped to mate with the rib elevation to which said side rail is attached over at least a portion of the cross-sectional profile of the rib elevation to which said side rail is attached.

3. The roofing system of claim 2 wherein each said rib elevation has an outside facing away from the roof penetration and an inside facing toward said roof penetration, and wherein the bottom shoulder structure of each side rail is attached to and mates with the outside of the respective rib elevation.

4. The roofing system of claim 1 wherein the roofing system: is a standing seam metal panel roofing system, and wherein the bottom shoulder structure of each side rail is attached to and mates with: only one side of the respective rib elevation.

5. The roofing system of claim 1 wherein the upstanding riser portion of each of said side rails has a top end and a bottom end and wherein said bottom shoulder structure extends from the bottom end of the respective riser portion.

6. The roofing system of claim 1 wherein said upstanding riser portion has a top end and a bottom end and wherein said upper flange extends from the top end of the respective riser portion.

7. The roofing system of claim 1 wherein said upstanding riser portion has a first side and a second side, and wherein the upper flange extends laterally from the first side of said riser portion and the bottom shoulder structure extends laterally from the second side of said riser portion.

8. The roofing system of claim 1 wherein the riser portion of each said side rail is in the form of a substantially continuous riser wall extending along the top of the respective rib elevation.

* * * * *